United States Patent [19]

Chaumard

[11] Patent Number: 4,504,100

[45] Date of Patent: Mar. 12, 1985

[54] APPARATUS FOR STORING AND DISPENSING PARALLELEPIPEDIC OBJECTS AND PACKETS, PARTICULARLY PACKETS OF CIGARETTES, BOXES AND OTHER ARTICLES

[76] Inventor: Yvette Chaumard, Impasse des Longènes-St.-Apollinaire, 21000 Dijon, France

[21] Appl. No.: 391,157

[22] Filed: Jun. 23, 1982

[30] Foreign Application Priority Data

Jun. 26, 1981 [FR] France ..... 81 12599

[51] Int. Cl.[3] ..... A47F 1/12

[52] U.S. Cl. ..... 312/71; 312/330 R; 312/350

[58] Field of Search ..... 312/71, 295, 319, 330 R, 312/330 SM, 35 G

[56] References Cited

U.S. PATENT DOCUMENTS

| | | | |
|---|---|---|---|
| 1,703,987 | 3/1929 | Butler | 312/71 X |
| 1,917,980 | 7/1933 | Kelsey | 312/205 X |
| 3,083,067 | 3/1963 | Vos et al. | 312/71 |
| 3,703,326 | 11/1972 | Riviers | 312/330 |

FOREIGN PATENT DOCUMENTS

| | | | |
|---|---|---|---|
| 2310603 | 3/1976 | France | 312/71 |
| 419302 | 5/1934 | United Kingdom | 312/71 |

*Primary Examiner*—Francis K. Zugel
*Assistant Examiner*—Joseph Falk
*Attorney, Agent, or Firm*—McAulay, Fields, Fisher, Goldstein & Nissen

[57] ABSTRACT

An apparatus for storing and dispensing parallelepipedic objects such as boxes, packets or like articles, comprises a main elongated body on which the objects are placed, one behind the other. A push element is mounted to slide longitudinally on this body and an elastic member urges the push element forwards so as to apply it against the last object in the line. An auxiliary body is mounted to slide longitudinally in the main body, to extend the latter over a variable length. The push element comprises guiding members cooperating with guides on the main body and on the auxiliary body to ensure continuous guiding of the push element over the whole length of the telescopic assembly formed by the two bodies.

17 Claims, 10 Drawing Figures

APPARATUS FOR STORING AND DISPENSING PARALLELEPIPEDIC OBJECTS AND PACKETS, PARTICULARLY PACKETS OF CIGARETTES, BOXES AND OTHER ARTICLES

BACKGROUND OF THE INVENTION

The present invention relates to an apparatus for storing and dispensing parallelepipedic objects and packets, particularly packets of cigarettes, boxes and other like articles.

Apparatus for storing and dispensing packets or boxes are already known which comprise a sectioned frame or rack in which a certain number of dispensing push elements urged forwards by a spring or an elastic bands are fixed by clipping or like process. Such a frame or rack often serves as front stop of the dispenser in order to contain the thrust exerted on the packets or boxes. However such apparatus present a certain number of drawbacks.

Firstly, it is often difficult to install them as they do not necessarily match the existing shelving. Furthermore, their price is always very high, as these apparatus require the addition of the frame or the rack, and, in the majority of cases, they necessitate installation of new shelving adapted to the dimensions of the dispensing assembly.

SUMMARY OF THE INVENTION

It is an object of the present invention to overcome these various drawbacks by providing a dispensing and storing apparatus of particularly simple design, which may be very easily adapted to all types of shelving of different depths and which is of low cost price.

To this end, this apparatus for storing and dispensing parallelepipedic objects such as boxes, packets or like articles, comprising a main elongated body on which the objects are placed, one behind the other, a push element mounted to slide longitudinally on this body and an elastic member urging the push element forwards so as to apply it against the last object in the line, is characterized in that it comprises an auxiliary body mounted to slide longitudinally in the main body, to extend the latter over a variable length, and the push element comprises guiding members cooperating with guides on the main body and on the auxiliary body to ensure continuous guiding of the push element over the whole length of the telescopic assembly formed by the two bodies According to a further feature of the invention, the push element comprises outer and inner guiding members cooperating respectively with outer guides provided on the main body and with inner guides provided on the auxiliary body. The apparatus according to the invention offers the advantage that it enables packets or boxes to be stored in a minimum volume on an existing shelving, whatever the width of said shelving, since the length of the main body and of the auxiliary body constituting the base of the apparatus may be adapted to the depth of the shelving. Furthermore, it always enables one packet to be entirely visible to the public and each box or packet can be easily gripped for sale thereof.

Several storing and dispensing apparatus according to the invention can also be arranged side by side so that the whole width of a shelf can be used.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
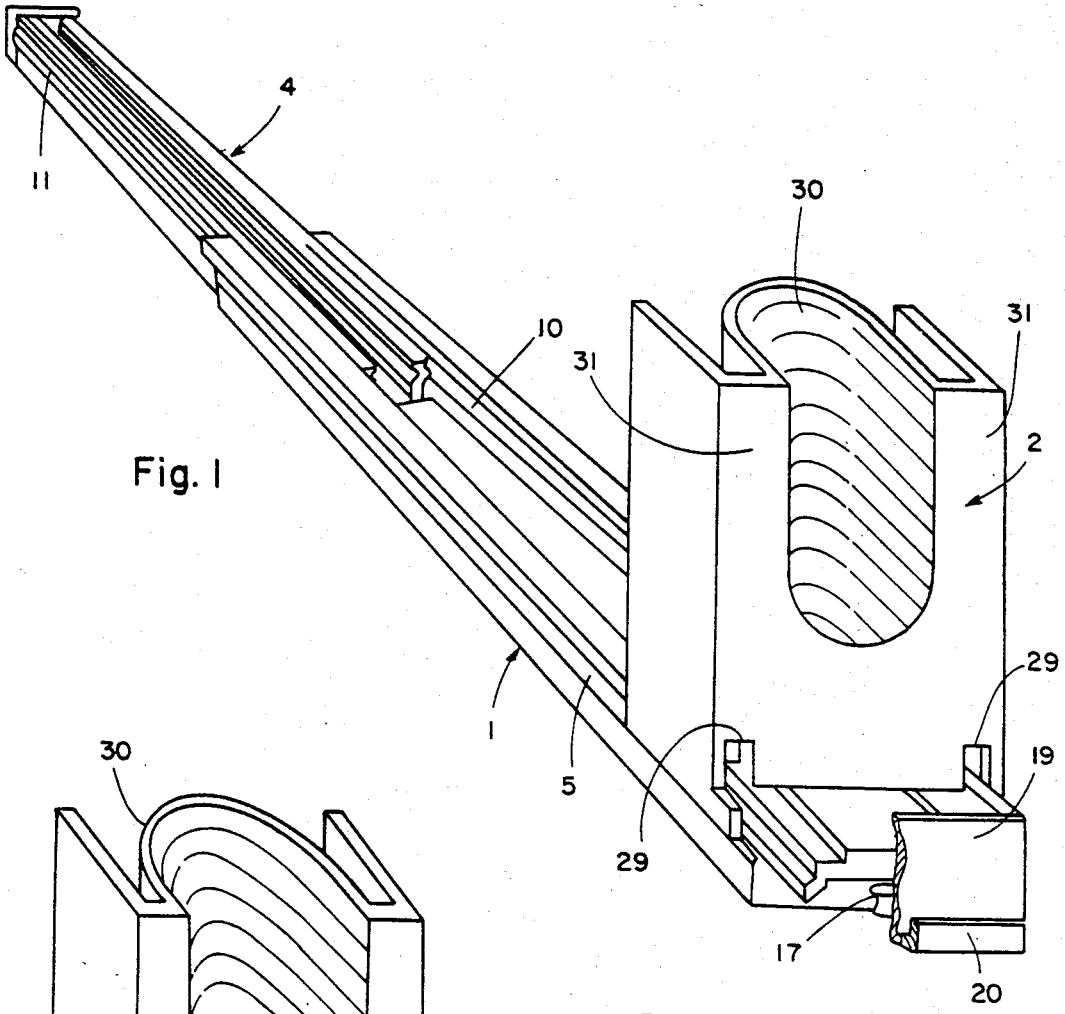
FIG. 1 is a view in perspective of a storing and dispensing apparatus according to the invention, the objects, such as boxes or packets, dispensed not being shown.

Referring now to the drawings, the apparatus for storing and dispensing parallelepipedic objects according to the invention, shown in FIG. 1, comprises an elongated main body 1 on which the objects are placed one behind the other. A push element 2 is mounted on this body for longitudinal slide thereon, which push element is applied against the last object in the series and is urged forwards by a spring 3.

The main body 1 is constituted by a section advantageously made of plastics material.

According to the invention, the main body 1 is extended rearwardly by an auxiliary body 4 which is mounted to slide longitudinally in the main body 1 and thus forms therewith a telescopic assembly whose length varies as a function of the depth of the shelving or the fixture in which the apparatus according to the invention is housed.

The push element 2 is shaped so as to be able to slide both on the front main body 1 and on the rear auxiliary body 4.

Figure 3:
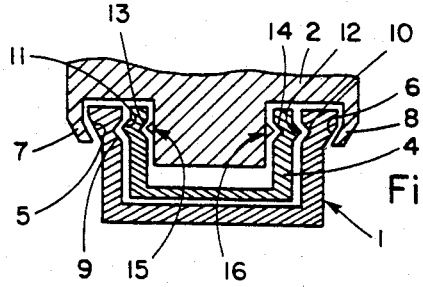
FIG. 3 is a view in transverse section of the main body, the auxiliary body and the lower part of the push element.
Figure 6:
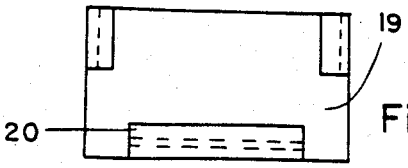
FIG. 6 is a front view, taken from the right in FIG. 5, of the main body.
Figure 4:
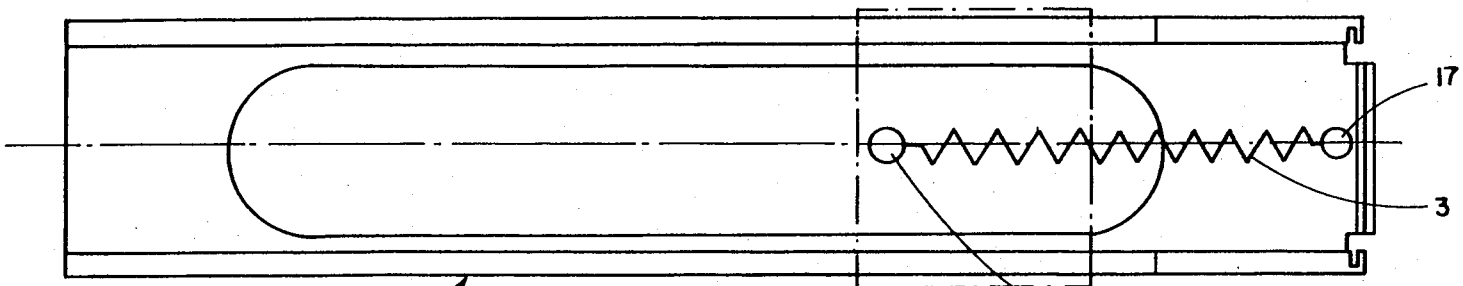
FIG. 4 is a plan view of the main body by itself.

The main body 1 and the auxiliary 4 each have a cross section substantially in U form, as may be seen more readily in FIG. 3. On its two vertical side walls, the main body 1 presents parallel longitudinal guides 5 and 6 which may be constituted by inclined ramps, as in the example illustrated, or by grooves or ribs. Respective outer guiding members 7 and 8 provided in the lower part of the push element 2 cooperate with these guides. These guiding members are constituted in the present case by downwardly and inwardly inclined ramps which slide along the ramps 5 and 6 forming the guides of the main body 1. However, the guiding members 7 and 8 may be constituted by ribs or grooves.

The main body 1 also presents, on the inner faces of its side walls, two guides 9 and 10 with which cooperate respective guiding members 11 and 12 provided in the outer faces of the two side walls of the auxiliary body 4. In the example illustrated the guides 9 and 10 are constituted by grooves in wich engage corresponding ribs 11 and 12 on the auxiliary body 4.

This auxiliary body 4 also presents, on the inner faces of its side walls, two inner guides 13 and 14 with which inner guiding members 15 and 16, fast with the lower part of the push element 2, respectively cooperate. These guiding members 15 and 16 may be constituted by ribs engaging in the grooves constituting the inner guides 13 and 14.

From the foregoing, it is therefore seen that the push element may slide over the main body 1 by its ramps 7, 8 constituting guiding members cooperating with the ramps 5 and 6 of the main body 1, and on the auxiliary body 4 by its guiding members or ribs 15 and 16 sliding in the inner guides 13 and 14 of the auxiliary body 4.

The height of the auxiliary body 4 is naturally slightly less than that of the main body 1, so that the upper faces of the two bodies 1 and 4 are at the same level.

The parallelepipedic objects to be dispensed are placed vertically on these upper faces and are pushed forwards by the push element 2 urged by the spring 3. This spring 3 is hooked to a catch 17 fast with the web of the section constituting the main body 1, at the front end thereof, and also to a catch 18 provided beneath the push element 2.

At its front end, the main body 1 presents a transverse front wall 19 in front of which extends a lower transverse edge 20. On the front wall 19 fits a vertical plate 21 forming stop, which, on its rear face, presents a U groove 22 engaging on the front wall 19. On its front face, the plate 21 presents a downwardly facing U groove 23 defining with the edge 20 a groove 24 of T-shaped cross section.

The plate 21 forming stop is preferably made of transparent material and a label may possibly be placed in position.

The groove 24 defined between the lower edge 20 and the upper rib 23 is adapted to receive an intermediate tongue 25 forming part of an insert 26 appropriately cut out from a sheet of cardboard or like material. This cardboard plate 26 is folded as a U so that the central web of the U, of very short height, can constitute the tongue 25 housed in the groove 24. The arms of the U are then folded longitudinally on either side of the main body 1 and they serve to separate the various rows of objects, when several dispensing apparatus are placed side by side. In this way, these objects do not catch on one another and this facilitates slide thereof.

Figure 5:
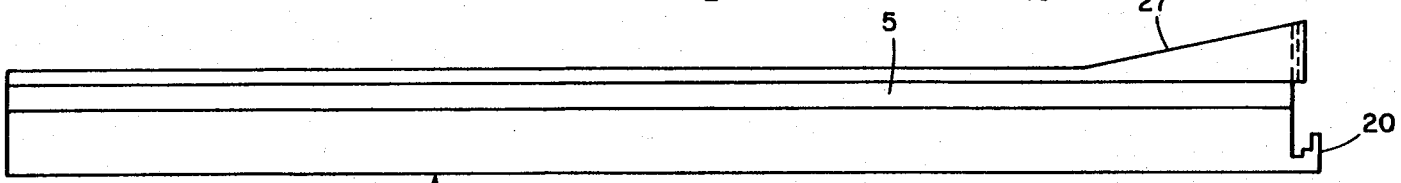
FIG. 5 is a view in elevation of the main body.
Figure 10:
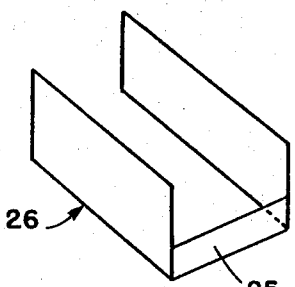
FIG. 10 is a schematic view in perspective of a cardboard insert cut out and folded in U form.
Figure 9:
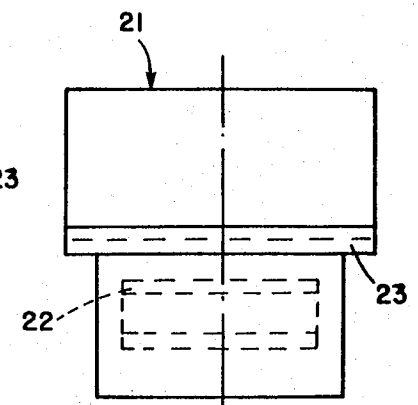
FIG. 9 is a front view of the plate forming stop.
Figure 8:
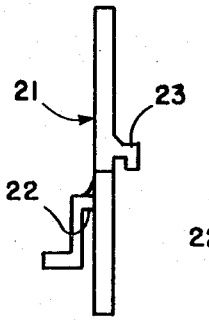
FIG. 8 is a side view of the plate forming stop.

As may be seen in FIG. 5, the main body presents, in its front part, two ramps 27 inclined upwardly and forwardly, on the upper part of the two side walls of the body 1. These two ramps 27 are intended to provoke the relative, progressive lifting of the first objects in the line as they are pushed forward by the push element 2.

Figure 7:
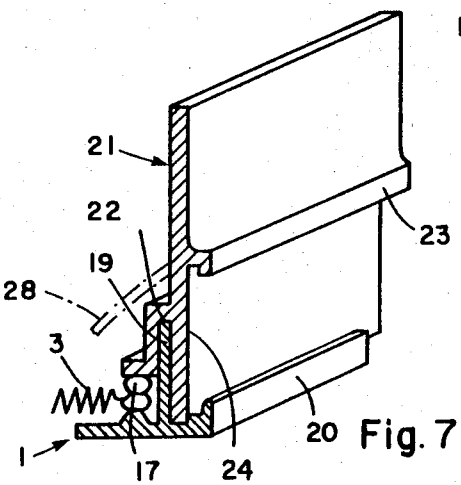
FIG. 7 is a view, partly in perspective, of the front part of the apparatus, provided with the plate forming stop.

According to a variant embodiment, the two ramps 27 of the body 1 may be replaced by a ramp 28 of the same inclination, provided on the plate 21 forming stop, this ramp being provided on the rear face of this plate and being indicated in dashed and dotted lines in FIG. 7.

To enable the push element 2 to advance up to the plate 21 forming stop, the push element 2 is provided in its lower part with two lateral notches 29 which are adapted to overlap the two ramps 27 when the push element 22 arrives in the front part of its stroke.

Figure 2:
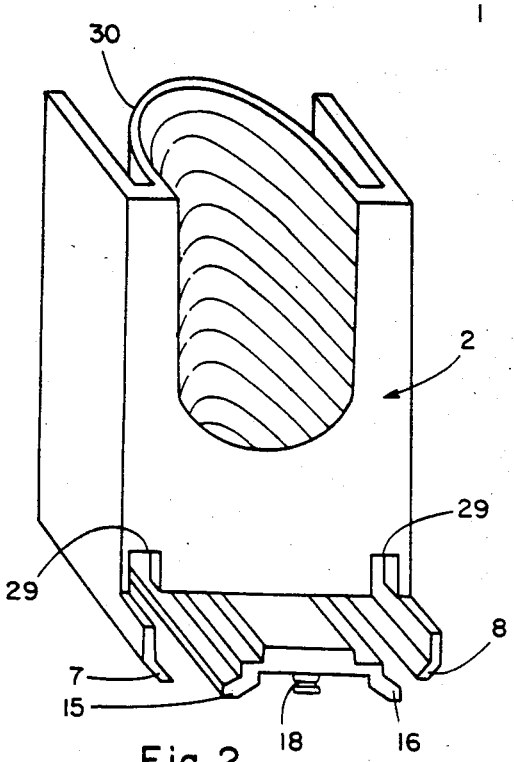
FIG. 2 is a view in perspective of the push element.

As may be seen in FIGS. 1 and 2, the push element 2 preferably presents, in its upper front part, a hollow portion 30 for accomodating a thumb during loading, during which operation the push element 2 is pushed rearwardly. This hollow portion 30 defines, in the front face of the push element 2, lateral arms 31 of smaller width surrounding a U-shaped notch so that the push element exerts, by each of the arms 31, a greater thrust per surface unit than the base of the push element, which thus avoids the objects, and in particular the packets, becoming crooked.

The apparatus according to the invention which has just been described is fixed on its support at three points for example by means of a double-face adhesive means or screws, namely two points located respectively at the front of and to the rear of the base of the main body 1, the third point being provided at the base of the sliding auxiliary body 4.

What is claimed is:

1. Apparatus for storing and dispensing parallelepipedic objects such as boxes, packets or like articles, comprising a main elongated body on which the objects are placed, one behind the other;

a push element mounted to slide longitudinally in said main body an elastic member urging the push element forwards so as to apply it against the last object in the line, an auxiliary body mounted to slide longitudinally in the main body, to extend the latter over a variable length;

guiding members on said push elements cooperating with guides on the main body and on the auxiliary body to ensure continuous guiding of the push element over the whole length of the telescopic assembly formed by the main and auxiliary bodies;

said main body having in its front part, ramps inclined upwardly and forwardly, said ramps being located plumb with the side walls of the main body; and said push element comprises, in its lowest part, lateral notches adapted to overlap the two ramps.

2. Apparatus according to claim 1, wherein the push element includes a U-shaped notch, and presents, in its upper, front part, a hollow portion defining in the front face of the push element side arms of smaller width surrounding said U-shaped notch.

3. Apparatus according to claim 1, wherein the push element comprises outer and inner guiding members cooperating respectively with outer guides provided on the main body and with inner guides provided in the auxiliary body.

4. Apparatus according to claim 1, wherein the main body presents, at its front end, a transverse front wall adapted to receive a plate forming front stop for the objects.

5. Apparatus according to claim 4, wherein the plate forming stop presents, on its rear face, a groove covering the front wall of the main body and, on its front face, a rib defining a groove with a lower edge of the main body.

6. Apparatus according to claim 5, wherein a tongue constituting the short web of a generally U-shaped insert is housed in the groove defined between the rib of the plated forming stop and the lower edge of the main body, the two side arms of the insert extending along the apparatus to separate the objects located in adjacent apparatus.

7. Apparatus according to claim 4, wherein the plate forming stop presents, on its rear face, a ramp inclined upwardly and forwardly.

8. Apparatus according to claim 1, wherein said apparatus is supported at three points, namely two points located respectively at the front and to the rear of the base of the main body and a third point at the base of the sliding auxiliary body.

9. Apparatus for storing and dispensing parallelepipedic objects such as boxes, packets or like articles, comprising a main elongated body on which the objects are placed, one behind the other;

a push element mounted to slide longitudinally on this body;

an elastic member urging the push element forward so as to apply it against the last object to the line;

an auxiliary body mounted to slide longitudinally in the main body, to extend the latter over a variable length;

guiding members on said push element cooperating with guides on the main body and on the auxiliary body to ensure continuous guiding of the push element over the whole length of the telescopic assembly formed by the main and auxiliary bodies; and said guide members comprise outer and inner guiding members cooperating respectively with outer guides provided on the main body and with inner guides provided in the auxiliary body.

10. Apparatus according to claim 9, wherein the main body presents, at its front end, a transverse front wall adapted to receive a plate forming front stop for the objects.

11. Apparatus according to claim 10, wherein the plate forming stop presents, on its rear face, a groove covering the front wall of the main body and, on its front face, a rib defining a groove with a lower edge of the main body.

12. Apparatus according to claim 11, wherein a tongue constituting the short web of a generally U-shaped insert is housed in the groove defined between the rib of the plated forming stop and the lower edge of the main body, the two side arms of the insert extending along the apparatus to separate the objects located in adjacent apparatus.

13. Apparatus according to claim 10, wherein the main body presents, in its front part, ramps inclined upwardly and forwardly, these ramps being located plumb with the side walls of the main body, and the push element comprises, in its lower part, lateral notches adapted to overlap the two ramps.

14. Apparatus according to claim 10, wherein the plate forming stop presents, on its rear face, a ramp inclined upwardly and forwardly.

15. Apparatus according to claim 10, wherein the main body presents, on its front part, a ramp inclined upwardly and forwardly.

16. Apparatus according to claim 9, wherein the push element includes a U-shaped notch and presents, in its upper, front part, a hollow portion defining in the front face of the push element side arms of smaller width surrounding said U-shaped notch.

17. Apparatus according to claim 9, wherein said apparatus is supported at three points, namely two points located respectively at the front and to the rear of the base of the main body and a third point at the base of the sliding auxiliary body.

* * * * *